United States Patent [19]

Vallak

[11] 4,016,002

[45] Apr. 5, 1977

[54] METHOD FOR REMOVING HEAT-INSULATING MATERIAL FROM AN INGOT MOLD BEFORE THE REMOVAL OF THE INGOT

[75] Inventor: Hannes Vallak, Geneva, Switzerland

[73] Assignee: Enn Vallak, Geneva, Switzerland

[22] Filed: Nov. 11, 1975

[21] Appl. No.: 630,788

Related U.S. Application Data

[63] Continuation-in-part of Ser. No. 450,430, March 12, 1974, abandoned.

[30] Foreign Application Priority Data

Mar. 20, 1973 Sweden ..... 7303892

[52] U.S. Cl. ..... 134/6; 15/312 A; 15/347; 134/8; 134/21; 164/158

[51] Int. Cl.[2] ..... B08B 5/04

[58] Field of Search ..... 134/8, 16, 17, 21, 6; 15/301, 308, 312 R, 312 A, 314, 347, 382, 395; 164/123, 158; 249/197, 200; 425/210, 225; 264/39; 209/139 R, 144

[56] References Cited

UNITED STATES PATENTS

| | | | |
|---|---|---|---|
| 1,719,542 | 7/1929 | Gathmann | 164/123 |
| 2,825,925 | 3/1958 | Acheson | 15/382 X |
| 3,534,658 | 10/1970 | Carsey | 15/312 R X |
| 3,535,730 | 10/1970 | McClure | 134/21 X |
| 3,766,965 | 10/1973 | Vallak | 164/123 |
| 3,929,183 | 12/1975 | Vallak | 164/123 |

*Primary Examiner*—S. Leon Bashore
*Assistant Examiner*—Richard V. Fisher
*Attorney, Agent, or Firm*—Finnegan, Henderson, Farabow & Garrett

[57] ABSTRACT

A method for removing heat-insulating material, at least some of which is frangibly caked, from an ingot mold before removal of the hot ingot from the mold comprising the steps of providing a low-pressure vacuum, conducting the vacuum through a rigid, manually manipulatable, heat-resistant conduit, and simultaneously fragmentizing the caked heat-insulating material with, and applying the low-pressure vacuum through, the rigid conduit for removing the heat-insulating material.

6 Claims, 3 Drawing Figures

METHOD FOR REMOVING HEAT-INSULATING MATERIAL FROM AN INGOT MOLD BEFORE THE REMOVAL OF THE INGOT

CROSS REFERENCES TO RELATED APPLICATIONS

This application is a continuation-in-part of copending U.S. Patent application Ser. No. 450,430, filed Mar. 12, 1974, now abandoned. The applicant, Hannes Vallak, and the assignee Enn Vallak, are the same for both applications.

BACKGROUND OF THE INVENTION

1. Field of the Invention

This invention relates to an improved method of removing heat-insulating material from an ingot mold prior to the removal of the ingot from the mold.

2. Description of the Prior Art

In steel making, there are a variety of ingot molds used for forming steel ingots. There are also a variety of methods used to counteract the contraction cavities which form during solidification of the ingot. The more common methods of counteracting the contraction cavities which form during solidification of the ingot entail the use of heat-retaining means, commonly referred to as "hot tops," alone or in conjunction with heat-insulating material. Examples of the various uses of hot tops and insulating material are depicted in Vallak U.S. Pat. No. 3,766,965.

Vallak teaches the use of permanent hot tops as an improvement over previous hot tops which were consumed or destroyed during solidification of the ingot. These previous consumable hot tops, which are still frequently used in steel production, are generally formed of heat-insulating and/or exothermic material held into the form by a bonding agent. On being exposed to the high temperatures associated with solidifying ingots, the bonding agent is destroyed leaving the heat-insulating material on top of the ingot. This material, which may consist of silica, asbestos, iron oxide and/or aluminum powder, is usually frangibly caked and must be removed prior to, or at the time of, removing the ingot from the mold.

The heat-insulating material in powder form, which is used in conjunction with consumable or permanent hot tops, is generally also composed of silica, asbestos, iron oxide and/or aluminum powder. This powdered insulating material, which is usually frangibly caked by the heat from the solidifying ingot, must also be removed prior to, or at the time of, removing the ingot from the mold.

The common methods of removing the caked insulating material result in wide dispersion of the material in the ingot stripping shop. One method, for example, is to invert the mold and permit the caked material to fall to the floor where it breaks apart into smaller caked pieces and releases a large amount of dust. Besides the inconvenience and hazard present due to the quantity of insulating material at temperatures of up to 800° C spread on the floor of the shop, the dispersion of great amounts of dust in the shop creates a severe health hazard to the shop personnel.

Airborne dust is responsible for the many serious disabling diseases, and the inhalation of any dust should be avoided. Some dusts, by virtue of their composition and particle size, are, however, particularly dangerous; relatively small concentrations in the atmosphere can, over the years, lead insidiously to serious and permanent damage to the lungs. It is unfortunate that both silica and asbestos, with their attractive thermal characteristics, are among the most dangerous sources of respirable dust.

There have been few attempts to reduce the disadvantages and hazards of the presently common methods of removing ingots from ingot molds. One such attempt is taught in Gathmann U.S. Pat. No. 1,719,542. While that patent teaches the use of suction to remove insulating material from the top of flat ingot molds in order to prevent its dispersion throughout the ingot-stripping shop, it has numerous disadvantages. The invention taught in Gathmann is a large, cumbersome, stationary machine requiring a great deal of power and requiring that the ingot molds be taken to the machine.

The primary difficulty with the invention in Gathmann is that the insulating material commonly used today is the type which cakes on being exposed to the heat of the solidifying ingot. Gathmann is intended to be used with insulating material that retains its powder composition so that it can be easily removed from the ingot mold by suction. In order for the invention in Gathmann to remove a caked layer of insulating material, a great deal of vacuum suction would have to be provided to break up and remove the caked material. In addition to the extreme inefficiency of the Gathmann method of removing caked insulating material, Gathmann does not provide a means for removing the insulating material which is located around the sides of the shrunken, solidified ingot within the mold and in the corners and recesses in the top of the mold before the removal of the ingot.

It is the disadvantages and hazards of the methods used to remove ingots from ingot molds, whether that of Gathmann or the other commonly used methods, that the instant invention is intended to ameliorate.

Other vacuum systems are known in the prior art. An example of such a system is taught in McClure U.S. Pat. No. 3,535,730. The prior art vacuum systems, however, are not designed nor intended for use with high temperature materials such as insulating material from ingot molds at temperatures up to 800° C. Further, the ends of the low-pressure conduits in the prior art systems are designed for removing loose particulate material and are not for use in reducing caked material to sizes less than the diameter of the orifice.

SUMMARY OF THE INVENTION

In accordance with the invention, as here embodied and broadly described, the method for removing high-temperature, heat-insulating material, at least some of which is frangibly caked, from an ingot mold before removal of the hot ingot from the mold comprises the steps of providing a low-pressure vacuum; conducting the low-pressure vacuum through a rigid, manipulatable, heat-resistant conduit; and simultaneously fragmentizing the frangibly caked heat-insulating material with, and applying the low-pressure vacuum through, the rigid conduit for removing the insulating material.

Preferably, the method also includes as part of the steps of fragmentizing the insulating material and applying the vacuum, the steps of manually hammering the caked insulating material with the rigid conduit. It is preferred that the rigid conduit be manually manipulatable and that the hammering continue until the size of the fragmented portions of the insulating material is reduced sufficiently for the fragmented portions to be removed through the conduit.

It is also preferred that the method include the step of applying the vacuum to uncaked heat-insulating material.

Preferably, the method includes the step of directing the manipulatable conduit into the corners and recesses in the top of the ingot mold for removing substantially all of the heat-insulating material located therein.

It is also preferred that the step of conducting the low-pressure vacuum include the step of providing sufficiently long, rigid conduits to permit the worker to remain at a distance from the mold to tolerate the heat.

The invention consists in the novel parts, steps, constructions, arrangements, combinations and improvements shown and described. The accompanying drawings, which are incorporated in and constitute a part of the specification illustrate one embodiment of the invention and together with the description, serve to explain the principles of the invention.

The present invention provides an improved method of removing heat-insulating material from ingot molds, which alleviates many of the hazards and inconveniences of the prior art methods.

The instant invention provides a means for removing heat-insulating material, at least some of which is frangibly caked, from an ingot mold while avoiding the dispersion throughout the ingot shop of dust and particles from the insulating material.

This invention provides a method of removing insulating material, at least some of which is frangibly caked, from ingot molds which utilizes apparatus that is portable and easily manipulatable by ingot-stripping shop workers.

The invention also provides a method of removing partially caked insulating material from the tops and recesses and corners of the tops of ingot molds before removal of the hot ingot.

Additional advantages of the invention will be set forth in part in the description which follows, and in part will be obvious from the description, or may be learned by practice of the invention. The advantages of the invention may be realized and attained by means of the instrumentalities and combinations particularly pointed out in the appended claims.

DESCRIPTION OF THE PREFERRED EMBODIMENT

Reference will now be made in detail to the present preferred embodiment of the invention by reference to FIG. 3 which depicts schematically apparatus suitable for using the method of the instant invention and FIGS. 1 and 2 which depict insulating materials in ingot molds the removal of which is the object of the instant invention.

In accordance with the invention, the method is for removing high-temperature, at least partially frangibly caked, heat-insulating material from an ingot mold prior to removal of the hot ingot from the mold. In FIG. 1 can be seen the top of a typical ingot mold 3 after it has been filled with molten metal 4. The left side of FIG. 1 shows the use of a consumable hot top 1 and heat-insulating material 6 as it is placed on the molten metal 4 after teeming into the mold 3.

The term "heat insulating material," when used generally herein both in the specification and the claims, includes both the material remaining after the hot top is consumed and the heat-insulating material placed onto the top of the molten metal after teeming it into the mold.

Figure 1:
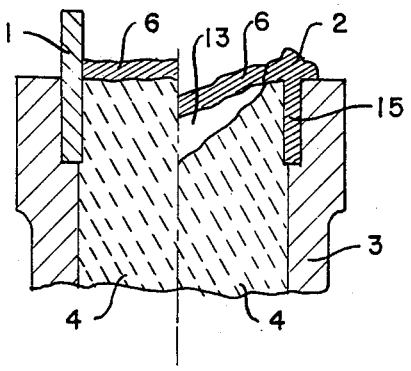
Fig. 1 PRIOR ART
FIG. 1 is a cross-sectional view of the top of an ingot mold in use. The left side of FIG. 1 depicts the top of the ingot mold after teeming of the metal into the mold and the utilization of a common "hot top" and insulating material. The right side of FIG. 1 shows the ingot, "hot top" and insulating material after the ingot has partially cooled and solidified to the point where it is ready for removal.

The right side of FIG. 1 shows the consumed hot top 2 and the frangibly caked heat-insulating material 6 after the ingot has solidified sufficiently to remove it from the mold 3. The bonding agent of the consumed hot top has been destroyed by the heat from the solidifying ingot 4 leaving the heat-insulating material 2 from which the hot top was formed. The heat-insulating material 6 is caked by the heat from the solidifying ingot 4 such that it is a self-supporting layer which is evident due to the gap 13 created under the heat-insulating material 6 by the shrinkage of the ingot 4 during cooling. Not only is the heat-insulating material 6 frangibly caked, but also the consumed hot top 2 is at least partially frangibly caked.

Figure 2:
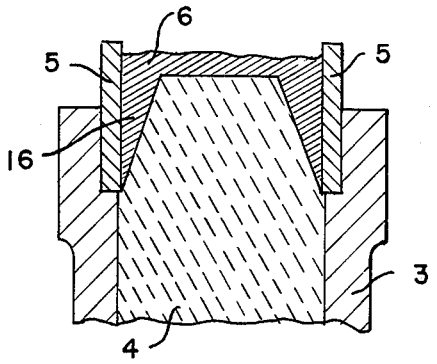
Fig. 2 PRIOR ART
FIG. 2 is a cross-sectional view of another type of ingot mold wherein the insulating material is placed on top of the solidifying ingot and held in place by a permanent hot top.

FIG. 2 depicts another type of ingot mold top using a permanent hot top 5 and heat-insulating material 6. As the ingot 4 solidifies, the heat-insulating material at least partially cakes, but the hot top 5 is not consumed.

Figure 3:
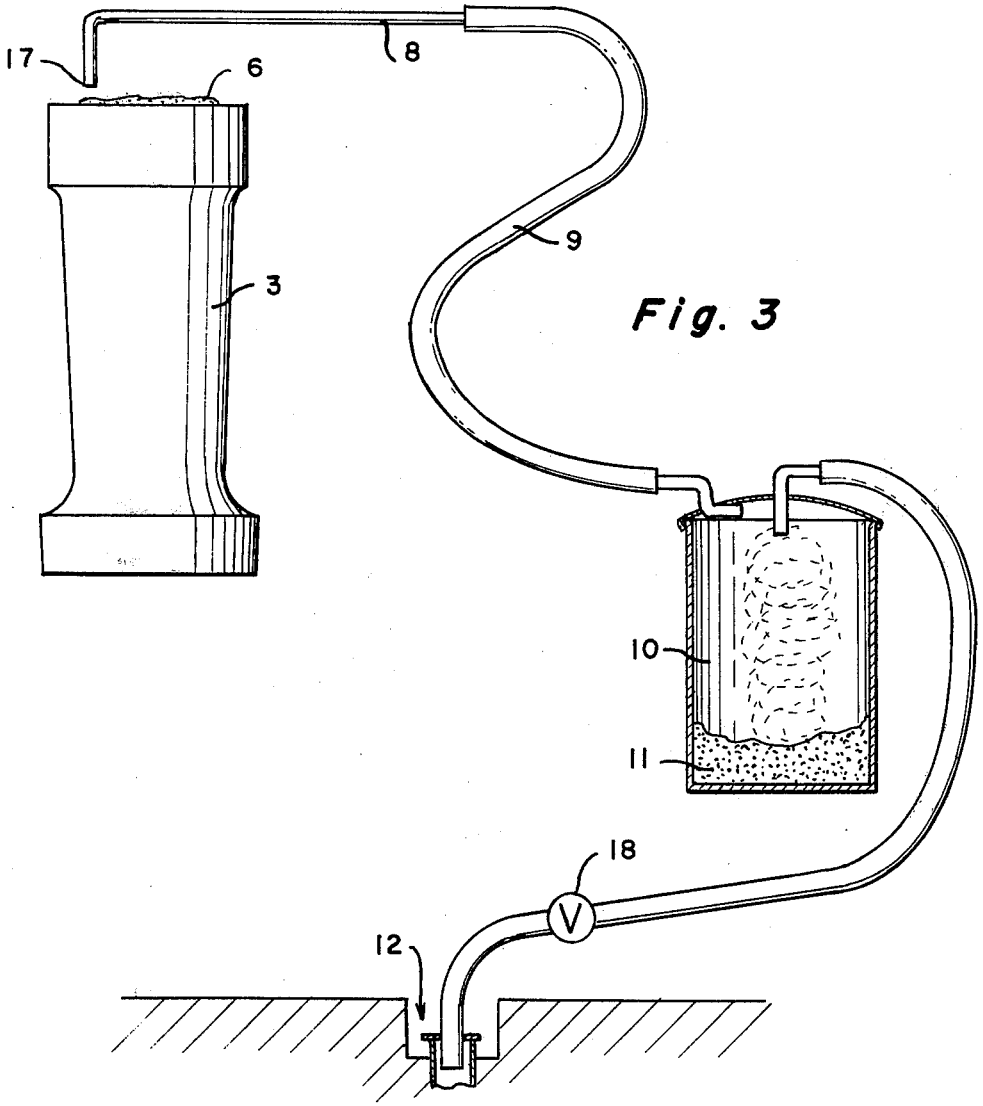
FIG. 3 depicts schematically apparatus suitable for removing insulating material from ingot molds in accordance with the teachings of this invention.

In accordance with the invention, as schematically depicted in FIG. 3, a low-pressure vacuum source 12 is provided. The low pressure vacuum is conducted through a rigid, manipulatable, heat-resistant conduit 8. As used herein, the term "low-pressure vacuum" signifies a relatively weak vacuum, since the fragmented heat-insulating material involved is of relatively light weight and the vacuum is applied directly to the material.

As herein embodied, the low-pressure vacuum is conducted from its source 12 to the rigid conduit 8 via a flexible, heat-resistant conduit 9. It is preferred that the low-pressure vacuum pass through a separator or collector such as a cyclone separator 10 in order to collect the heat-insulating material 11 which is removed from the ingot mold. The collected heat-insulating material 11 may be re-used or discarded.

The rigid conduit 8 as herein embodied, is manually manipulatable due to the existence of the flexible heat-resistant conduit 9. Further, as depicted in this embodiment, the individual doing the manual manipulation must bear the weight of the rigid conduit 8 and at least part of the flexible conduit 9. It is possible to suspend the rigid conduit 8 from an overhead or other movable crane system so that personnel manipulating the rigid conduit 8 will not have to bear the total weight of it.

The rigid conduit 8 as herein embodied and depicted is an elongated metal pipe one end of which is in fluid flow communication with the flexible conduit 9 and a portion of the other end 17 of which is bent 90° to facilitate conducting the low-pressure vacuum to the heat-insulating material 6 in the top of the ingot mold 3.

The structure of the manually manipulatable, rigid conduit 8 as depicted is only one embodiment. It is possible to utilize a rigid conduit which is straight and vertically suspended above molds and which can be manually manipulatable in a vertical direction to accomplish the method of this invention. Although the conduit 8 is shown in a manually manipulatable embodiment, it is foreseen that the rigid conduit may be mechanically utilized to simultaneously fragmentize the caked material and apply the low-pressure vacuum to the fragmented material.

In accordance with the invention, the partially frangibly caked heat-insulating material 6 is fragmentized with the rigid conduit 8. Simultaneously with the fragmentizing of the caked heat-insulating material, the low-pressure vacuum is applied to the heat-insulating material through the rigid conduit 8.

It is preferred that the frangibly caked heat-insulating material 6 be fragmentized by hammering it with the end 17 of the rigid conduit 8. No matter by what means the rigid conduit 8 is suspended, it must be sufficiently manipulatable to permit the hammering of the frangibly caked heat-insulating material with the end of the rigid conduit 8.

It is also preferred that the caked insulating material 6 be fragmentized by manual hammering until the size of the fragmented portions is reduced to that which can be removed by the low-pressure vacuum through the rigid conduit 8 and, in this embodiment, the flexible conduit 9.

It is also preferred that the end 17 of the rigid conduit 8 be manually directed into corners and recesses in the top of the ingot mold in order to remove substantially all of the frangibly caked and loose heat-insulating material. As can be seen in the right side of FIG. 1, the consumed hot top leaves a substantial portion of heat-insulating material in the gap 15 between the partially solidified ingot 4 and the mold 3. In order to remove that insulating material 2, the end 17 of the rigid conduit 8 must be at least partially inserted into the gap 15. In FIG. 2, the recesses 16 between the permanent hot top 5 and the top sides of the ingot 4 must also be cleaned of heat-insulating material and, therefore, necessitates the direction of the end 17 of the rigid conduit 8 into those recesses.

Two conflicting requirements must be taken into consideration in the design of the rigid conduit 8 and its end 17. On the one hand, the hammering of the frangibly caked heat-insulating material and its reduction to fragmented portions of a size which may be removed through the conduit 8 would be facilitated if the end 17 of the conduit 8 were flared to a hammer-like surface with an orifice in its center. On the other hand, the necessity of directing the end 17 of the rigid conduit 8 into recesses such as previously described and depicted in FIGS. 1 and 2 requires that the end 17 be as small a diameter as possible. It may be preferable to have a variety of rigid conduits 8 of different sizes and shapes which are interchangeable or a plurality of rigid conduits interconnected with the same vacuum source. One embodiment may be designed particularly for hammering, for example, and another embodiment may be tapered for use in corners and crevices.

It is also preferred that the low-pressure vacuum be applied through the rigid conduit 8 to uncaked heat-insulating material which remains in the top of the ingot mold 3. Not all of the heat-insulating material will be frangibly caked at the point when the ingot is to be removed from the mold. It is, of course, necessary to remove substantially all of the heat-insulating material, whether caked or not, in order to prevent the dispersion of the hazardous dust and particles.

Preferably, the step of conducting the vacuum includes the step of providing a sufficiently long manually manipulatable rigid heat-resistant conduit 8 to permit the worker to manually manipulate the conduit 8 while tolerating the heat from the ingot mold 3. Due to the necessity of hammering the caked insulating material 6 and of directing the end 17 of the rigid conduit 8 into recesses and corners 15 and 16 (FIGS. 1 and 2), precise manual control and physical observation are necessary. Therefore, by whatever method the rigid conduit 8 is manually manipulated, it will be necessary that personnel of the ingot-stripping shop be proximate to the ingot mold 3 and it is, therefore, necessary to provide a means to manually manipulate the rigid conduit 8 and be sufficiently distant from the mold 3 to permit tolerance of the heat. The rigid conduit is, therefore, made long enough to allow the operator to stand away from the hot ingot and mold.

Means for controlling the magnitude of the vacuum may be provided to enable vacuum selection depending upon the type, quantity or size of fragmented portions of the heat-insulating material or upon the diameter of the rigid conduit 8 and, in this embodiment, the flexible conduit 9. Such control means can be any conventional pressure control valve 18. While the low-pressure vacuum would not be a perfect vacuum, it is necessary that sufficient suction pressure be provided to aspirate substantially all of the heat-insulating material in the top of an ingot mold.

The apparatus necessary to accomplish the method of this invention must all be substantially heat-resistant since the heat-insulating material removed from ingot molds has, generally, a temperature in the vicinity of 800° C.

The invention provides a method for safely and efficiently removing at least partially frangibly caked insulating material from ingot molds prior to removing the hot ingot from the mold, thereby eliminating the disorder and the health hazard which would have been created had the insulating material been dispersed in the ingot-stripping shop.

It will be apparent to those skilled in the art that various modifications and variations could be made in the method of the invention without departing from the scope or spirit of the invention.

What is claimed as new and desired to be secured by Letters Patent of the United States is:

1. A method for removing heat-insulating material, at least some of which is frangibly caked, from a partially cooled ingot mold containing a relatively hot ingot before removal of the hot ingot from the mold, comprising the steps of:

a. providing a low-pressure vacuum;

b. conducting said low-pressure vacuum through a rigid, manipulatable, heat-resistant conduit; and c. simultaneously fragmentizing portions of the caked heat-insulating material with, and applying the low-pressure vacuum through, said rigid conduit for removing the material from the mold.

2. The method of claim 1 wherein the step of fragmentizing the heat-insulating material and applying the low-pressure vacuum includes the step of manually hammering the caked material.

3. The method of claim 2 wherein the step of hammering includes the step of manually manipulating the rigid conduit to reduce the size of the fragmented portions of the heat-insulating material until said material is removable through said conduit.

4. The method of claim 1 also including the step of applying the low-pressure vacuum through the conduit to heat-insulating material that remains uncaked upon commencing removal of said material from the mold.

5. The method of claim 1 wherein the step of conducting the low-pressure vacuum includes the step of providing a sufficiently long rigid conduit permitting a manual manipulator to be located sufficiently distant from said mold in order that said manipulator can tolerate the heat of the mold.

6. The method of claim 1 also including, after the removal of the heat-insulating material from the mold, collecting the removed heat-insulating material for re-use or disposal.

* * * * *